US006066430A

United States Patent [19]

Tsutsui et al.

[11] Patent Number: 6,066,430

[45] Date of Patent: May 23, 2000

[54] MONO-COMPONENT DEVELOPING METHOD AND MONO-COMPONENT DEVELOPING MACHINE FOR EFFECTUATING THE METHOD

[75] Inventors: Chikara Tsutsui, Nishinomiya; Masahiro Anno, Sakai; Minoru Nakamura, Itami; Katsunori Kurose, Amagasaki; Hiroyuki Fukuda, Sanda, all of Japan

[73] Assignee: Minolta Co., Ltd., Osaka, Japan

[21] Appl. No.: 09/243,461

[22] Filed: Feb. 3, 1999

[30] Foreign Application Priority Data

Feb. 4, 1998 [JP] Japan ..... 10-023092

[51] Int. Cl.[7] ..... G03G 13/095

[52] U.S. Cl. ..... 430/120; 399/283

[58] Field of Search ..... 399/283, 285; 430/109, 111, 120

[56] References Cited

U.S. PATENT DOCUMENTS 4,623,605 11/1986 Kato et al. .
4,626,487 12/1986 Mitsuhashi et al. .
4,987,454 1/1991 Natsuhara et al. .
4,996,126 2/1991 Anno et al. .
5,272,040 12/1993 Nakasawa et al. .
5,387,963 2/1995 Kajimoto et al. ..... 399/285
5,504,559 4/1996 Ojima et al. .
5,568,236 10/1996 Toda et al. .
5,612,159 3/1997 Sato et al. .
5,659,857 8/1997 Yamazaki et al. .

*Primary Examiner*—John L. Goodrow
*Attorney, Agent, or Firm*—McDermott, Will & Emery

[57] ABSTRACT

The present invention provides a mono-component developing method comprising the steps of: supplying a mono-component developer containing a toner particles having an average shape factor (SF value) of 100 to 150 to a developer transporting member;

regulating the developer on the developer transporting member by a regulating member to form a thin developer-layer on the transporting member;

transporting the thin developer-layer by the transporting member to develop an electrostatic latent image; and after development, making a residual developer on the developer-transporting member in contact with a static erasing member applied with a voltage having a polarity opposite to a charging polarity of the toner particles, and also provides a mono-component developing machine for effectuate the above method.

25 Claims, 4 Drawing Sheets

MONO-COMPONENT DEVELOPING METHOD AND MONO-COMPONENT DEVELOPING MACHINE FOR EFFECTUATING THE METHOD

This application is based on application(s) No. Hei 10-23092 filed in Japan, the contents of which are hereby incorporated by reference.

BACKGROUND OF THE INVENTION

1. Field of the Invention

The present invention relates to a developing method for developing an electostatic latent image in an electrophotography or electrostatic printing, particularly to a mono-component developing method using a mono-component developer.

2. Description of the Prior Art

Generally, two-component developing methods and mono-component developing methods are known in the art for use in a developing machine. However, mono-component developing methods are often adopted in view of preventing the decrease in charging efficiency and reducing the size of image forming apparatus.

In a mono-component developing method, a toner-regulating blade is disposed to contact with a developing sleeve. By passing a mono-component developer through a gap between the developing sleeve and the toner-regulating blade, a thin toner-layer is formed on said sleeve and charged, and the thin toner-layer is directly transported to a developing area to develop an electrostatic latent image formed on an electrostatic latent image-supporting member. More specifically, the development is carried out using a mono-component developing machine, for example, as shown in FIG. 4.

Namely, the developing machine of FIG. 4 includes a driving roller 91 which is rotated and driven by a driving means (not shown) in a CCW direction, a flexible developing sleeve 92 having an inner diameter a little larger than an outer diameter of said roller is fitted on the driving roller from outside; both ends of said sleeve is pressed onto the driving roller 91 from the rear by a pressing guide 93; and a slack portion 920 of the developing sleeve 92 formed on the opposite side by said pressing is in soft contact with an electrostatic latent image-supporting member PC(photoreceptor drum in this example). Also, a toner-regulating blade 94 is in contact with the developing sleeve 92 from the same side as the pressing guide 93.

A buffer chamber 95 is disposed at the rear of the developing sleeve 92, and further a toner supplying chamber 96 is disposed at the rear thereof. A toner supplying rotary member 97 (rotating in the CCW direction) is disposed in the buffer chamber 95, and a toner stirring/supplying rotary member 98 (rotating in a CW direction, i.e. in a clockwise direction) is disposed in the toner supplying chamber 96. Further, a bottom sealing member 99 abuts a bottom surface of the developing sleeve 92 for preventing the toner from leaking to the outside of the buffer chamber 95.

According to this developing machine, a toner T introduced into the buffer chamber 95 from the toner supplying chamber 96 by rotation of the rotary member 98 is successively supplied onto a surface of the developing sleeve 92 in a toner supplying area by rotation of the toner supplying rotary member 97. Meanwhile, the sleeve 92 rotates to follow the rotation of the driving roller 91 by friction. The toner T supplied to the sleeve 92 is charged electrically by friction under a pressure from the blade 94 and held on the surface of the sleeve 92 as a thin layer of a predetermined thickness by passing through a gap between the toner-regulating blade 94 and the developing sleeve 92. The toner T is transported to a developing area that faces the photoreceptor drum PC to be subjected to development of an electrostatic latent image under a developing bias $V_B$ from a power source 921.

A residual toner T after the development passes through a gap between the sealing member 99 and the developing sleeve 92 to be returned to the buffer chamber 95 in accordance with the rotation of the sleeve 92. The toner that has returned to the buffer chamber 95 is released from the sleeve 92.

However, in such a mono-component developing method, the residual toner that has not been used for development and is remaining on the sleeve is unlikely to be completely separated in the buffer chamber due to the friction charging of the toner by the toner-regulating blade. Therefore, the toner is accumulated on the sleeve by repetition of the copying operation and receives a stress for many times by the regulating blade, whereby the toner may be smeared onto the sleeve to generate toner-filming or the toner may be fixed onto the blade to decrease the thin toner layer-forming efficiency to generate fogging on the photoreceptor, causing a problem of poor development.

Further, the stress in the above-mentioned gap causes deterioration of the toner, namely, decrease in toner particle size and separation of fluidizing agents (for example, silica) added to the toner particles, thereby decreasing the fluidity of the toner particles and deteriorating the follow-up properties of black solid image and the like. Also, since the toner particles of small particle size are especially unlikely to be separated from the sleeve, the problem of toner filming on the sleeve (referred to "sleeve filmin" hereinafter) and photoreceptor fogging will be more conspicuous by reduction of particle size of the toner particles.

With the increase in the number of small-size particles, the number of accumulated toner particles will increase. Therefore, the toner newly added to the sleeve is charged not only by the regulating blade but also by friction among the toner particles themselves, so that the number of toner particles charged in a polarity opposite to the normal charging polarity increases, resulting in deterioration of the image quality.

SUMMARY OF THE INVENTION

The present invention is to provide a mono-component developing method having an excellent anti-adhesion properties in which sleeve-filming and photoreceptor fogging are not easily generated and in which toner particles, especially small-size toner particles, are not easily accumulated on a sleeve.

The present invention provides a mono-component developing method comprising the steps of: supplying a mono-component developer containing a toner particles having an average shape factor (SF value) of 100 to 150 to a developer transporting member;

regulating the developer on the developer transporting member by a regulating member to form a thin developer-layer on the transporting member;

transporting the thin developer-layer by the transporting member to develop an electrostatic latent image; and after development, making a residual developer on the developer-transporting member in contact with a static erasing member applied with a voltage having a polarity opposite to a charging polarity of the toner particles.

The present invention also relates to a mono-component developing machine for effectuate the above method.

BRIEF DESCRIPTION OF THE OF THE DRAWINGS

DETAILED DESCRIPTION OF THE INVENTION

The present invention relates to a mono-component developing method comprising the steps of: supplying a mono-component developer containing a toner particles having an average shape factor (SF value) of 100 to 150 to a developer transporting member;

regulating the developer on the developer transporting member by a regulating member and to form a thin developer-layer on the transporting member;

transporting the thin developer-layer by the transporting member to develop an electrostatic latent image; and after development, making a residual developer on the developer-transporting member in contact with a static erasing member applied with a voltage having a polarity opposite to a charging polarity of the toner particles.

The present invention also provides a mono-component developing machine for effectuate the above method.

The inventors of the present invention have found out that, in such a conventional mono-component developing method, a residual developer which has not been used for development and is remaining on the sleeve can be deprived of its static electricity by applying a voltage having a polarity opposite to that of toner particles to the static eraser, and separation of the toner particles, especially small-size particles, from the sleeve in the buffer chamber can be promoted by using spherical toner particles having a specific average shape factor. Thus it has been made possible to provide a mono-component developing method and a mono-component developing machine having an excellent anti-adhesion properties in which sleeve-filming and photoreceptor fogging are not easily generated and in which small-size toner particles are not easily accumulated on the sleeve.

The present invention will be detailed with reference to a mono-component developing machine shown in FIG. 1 as an example of a mono-component developing machine in which the mono-component developing method of the present invention is adopted.

Figure 4:
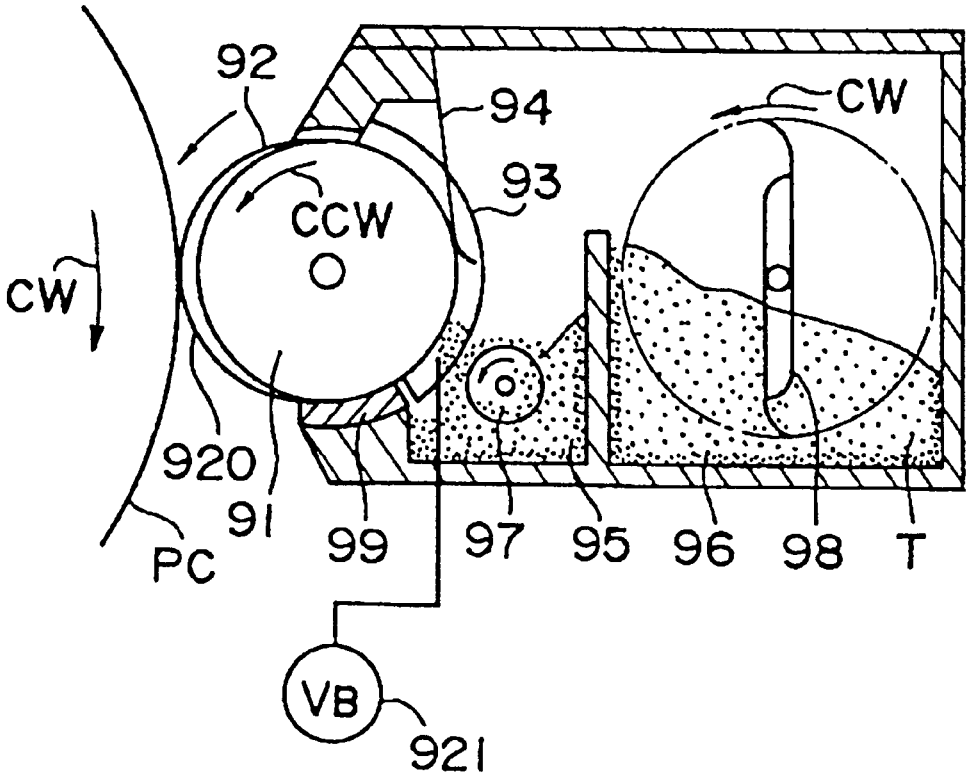
FIG. 4 is a schematic view showing a construction of a conventional developing machine.

A developing machine shown in FIG. 1 has substantially the same construction and function as a conventional developing machine shown in FIG. 4 except that a static eraser 119, which is illustrated below, is provided. The developing machine includes a driving roller 101, a flexible developing sleeve 102 fitted onto the roller from outside, a pressing guide 103 for pressing the sleeve onto the driving roller 101, a developer-regulating blade 104 in contact with the developing sleeve 102, a buffer chamber 105, a developer supplying chamber 106, a developer supplying rotary member 107 disposed in the buffer chamber 105, and a developer-stirring/supplying rotary member 108 disposed in the developer supplying chamber 106, wherein the reference symbol T represents a toner being used. The driving roller 101 and the member 107 are rotated and driven in a CCW direction shown in FIG. 1, and the member 108 is rotated and driven in a CW direction shown in FIG. 1, respectively by a driving motor (not shown). In the developing sleeve 102, a slack portion 120 formed on the opposite side by pressing of the pressing guide 103 is in soft contact with a surface of a photoreceptor drum PC of a copying machine in this example. A bottom sealing member 109 made of a soft elastic material such as a molt plane is provided for preventing the toner T from leaking to the outside of the buffer chamber 105.

Figure 1:
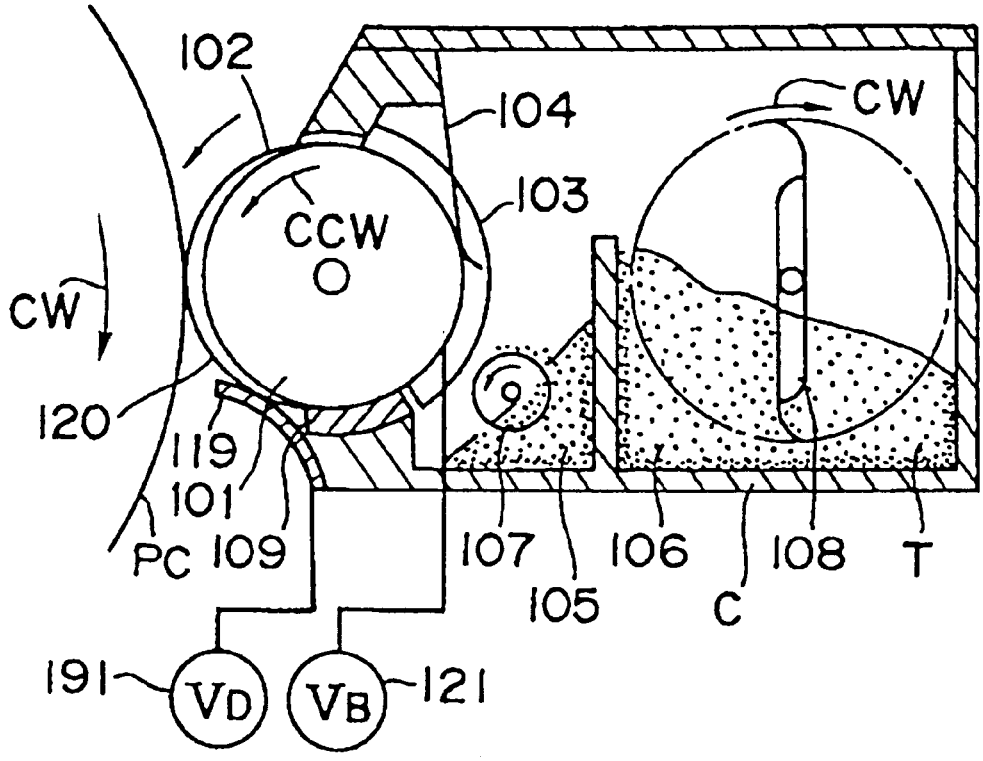
FIG. 1 is a schematic view showing a construction of an example of a developing machine in which the method of the present invention is adopted.
Figure 2:
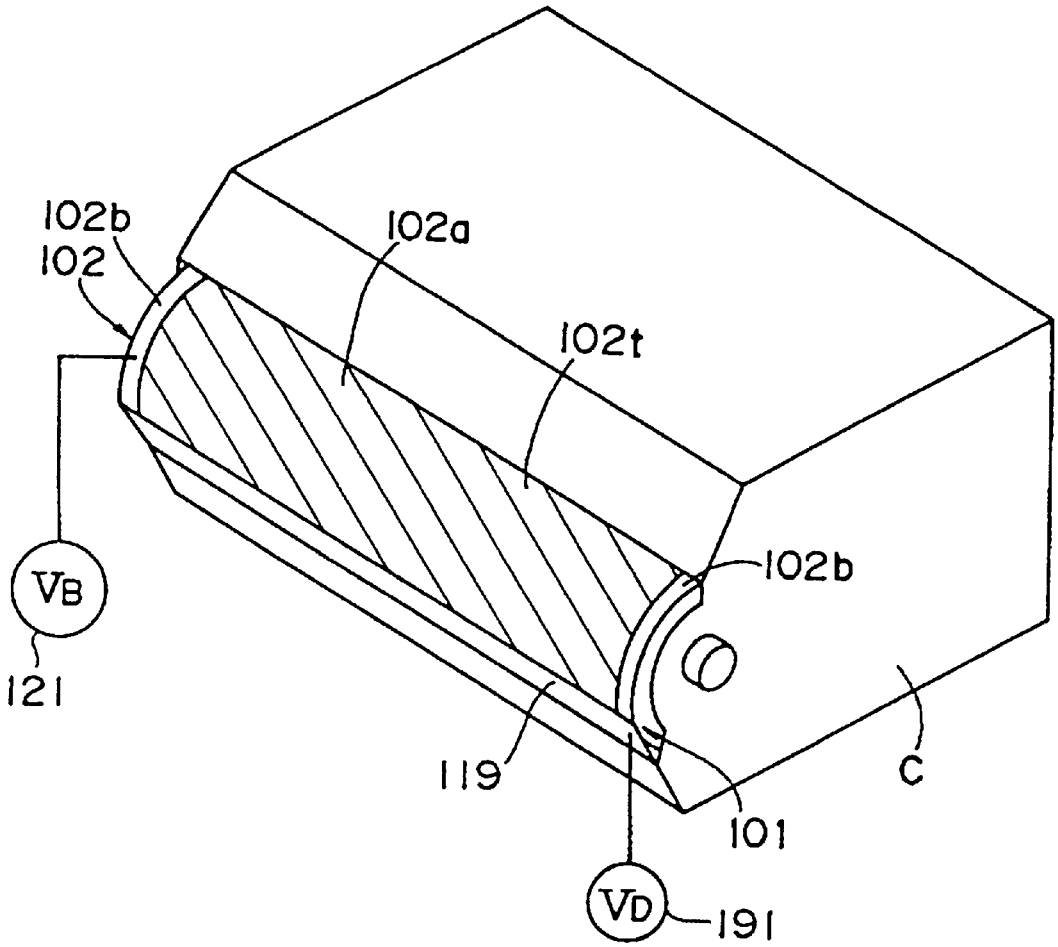
FIG. 2 is a perspective view of an example of a developing machine in which the method of the present invention is adopted.

The static eraser 119 abuts the developing sleeve 102 entirely along the direction transverse to the surface-moving direction CCW of the developing sleeve 102 through the intermediary of a toner layer 102*t* (See FIG. 2). In other words, in a perspective view of the mono-component developing machine shown in FIG. 2, the static eraser 119 is in contact with the entire toner layer in a longitudinal direction of the developing sleeve 102. However, the pressing force of the developer-regulating blade 104 (See FIG. 1, housed in the machine in FIG. 2) at both ends of the developing sleeve 102 is lower than that at the central portion of the sleeve, so that the force of regulating the amount of toner adhesion onto the developing sleeve 102 is weak on the ends of the developing sleeve 102. Accordingly, a problem such as abnormal toner adhesion and filming may possibly occur on the ends of the sleeve 102 even if no problems are raised in the central portion of the sleeve 102, so that the static eraser may be allowed to be in contact only with the toner layer on the both ends of the developing sleeve.

The dimension of the static eraser can be suitably set because it depends on the dimension of the developing machine to which the static eraser is applied. Especially, the thickness of the static eraser is usually set to be 0.15 to 0.25 mm, preferably 0.2 to 0.25 mm, so as to maintain the above pressure.

In the developing machine shown in FIG. 1, the static eraser 119 is disposed to abut the developing sleeve 102 at a position between the area where the developing sleeve 102 faces the photoreceptor drum PC and the bottom sealing member 109. However, the position is not specifically limited, so that the static eraser may be disposed at a site from downstream of the developing area to the developer-supplying area in the rotation direction of the developing sleeve 102. For example, the static eraser may be disposed at a position from the bottom sealing member 109 to the developer-supplying area so as to abut the developing sleeve 102 or to face the developing sleeve 102 so that the static eraser functions as the bottom sealing member 109.

The static eraser is made of a material deviated to the same polarity side as the normal charging polarity of the toner on a charging series as compared with the toner T, and a material having a good electrical conductivity is dispersed in the static eraser. Examples of the material deviated to the same polarity side as the normal charging polarity of the toner on a charging series as compared with the toner T include fluorine-based resins such as ethylene tetrafluoride resin with respect to the toner having a negative charging properties, and polyamides (nylon) and silicon-based resins with respect to the toner having a positive charging properties. Examples of the material having a good electric conductivity to be dispersed in these materials include carbon, various electrically conductive metal particles, and suitable charge-controlling substances. If the material having a good electrical conductivity to be dispersed is a hard one, it is preferable because the wearing of the static eraser can be suppressed. Here, the term "dispersion" refers to a concept including application of a charge-controlling substance and the like.

The above-mentioned material having a good electric conductivity is dispersed in the resin or on the surface of the resin at an amount of 10 to 30 parts by weight relative to 100 parts by weight of the resin so that the surface of the obtained static eraser may have a surface resistance of $10^2$ to $10^6$ Ω, preferably $10^3$ to $10^5$ Ω. If the surface resistance exceeds $10^6$ Ω, the electric charge does not move from the residual toner layer on the sleeve to the static eraser smoothly, so that the residual toner does not easily separate from the sleeve in the buffer chamber. Sleeve filming and photoreceptor fogging are liable to be generated. On the other hand, if the surface resistance is less than $10^2$ Ω, the leaks are generated, making the developing bias unstable and generating density unevenness and the like.

A static-erasing bias power source 191 is connected to the static eraser to apply a voltage having a polarity opposite to that of the toner. The applied voltage, i.e. the static-erasing bias voltage $V_D$, is 50 to 100 V, preferably 50 to 80 V. Thus, by applying the above static-erasing bias voltage $V_D$ having a polarity opposite to that of the toner, the electric charge can move smoothly from the residual toner layer, which is remaining on the developing sleeve 102 without being consumed after the development of the electrostatic latent image on the photoreceptor drum PC, to the static eraser.

If the static-erasing bias voltage $V_D$ has an absolute value of less than 50 V, the electric charge does not move sufficiently from the residual toner layer to the static eraser so that the residual toner does not easily separate from the sleeve in the buffer chamber. Sleeve filming and photoreceptor fogging are liable to be generated. On the other hand, if the electrostatic-erasing bias voltage $V_D$ has an absolute value exceeding 100 V, the amount of oppositely charged toner increases in the toner layer due to injection of electric charge from the static eraser. Photoreceptor fogging is liable to be generated.

Here, as shown in FIG. 2, the developing sleeve 102 is usually constructed in such a manner that its central portion 102*a* (hatched area) is used to hold the toner layer 102*t* for toner transportation, and no toner layer is formed on the ends 102*b* for preventing the toner from leaking outside of the ends. Therefore, if the static eraser has a width extending entirely over the developing sleeve 102 along the direction transverse to the surface-moving direction of the developing sleeve 102, the static eraser abuts the developing sleeve through the intermediary of the toner layer 102*t* at the central portion 102*a* and is in direct contact with the developing sleeve at the both ends 102*b*. Thus, by bringing the static eraser into direct contact with the developing sleeve and setting the developing bias voltage $V_B$ applied to the developing sleeve to be 0 so as to allow the developing sleeve to have the same potential $V_D$ as the static eraser, the static electricity elimination of the residual toner on the developing sleeve can be promoted. Also, since there will be no need for an insulating material for preventing electric conduction between the static eraser and the developing sleeve and for preventing the leakage, reduction of costs can be achieved.

According to the developing machine as explained above, the residual toner T left unconsumed among the toner T held on the surface of the developing sleeve 102 for development in the developing area passes through a gap between the static eraser 119 and the sleeve 102, while being in contact with the static eraser 119 which is in contact with the sleeve 102, to return to the buffer chamber 105. The residual toner is deprived of its electricity or inversely charged by friction with the static eraser when the residual toner passes while being in contact with the static eraser, so that the residual toner is brought into a state in which the residual toner is easily separated from the surface of the developing sleeve 102 when it has returned to the buffer chamber 105.

Since a material having a good electric conductivity is dispersed in the static eraser, the electric charge generated in the static eraser by friction between the static eraser and the toner T that passes while being in contact therewith is allowed to escape through the material having a good electric conductivity, so that accumulation of electric charge in the static eraser is prevented. Therefore, even if an image formation is repeated for many times and the toner on the developing sleeve passes the static eraser while being in contact therewith, the toner is deprived of its electricity or oppositely charged each time.

The mono-component developing machine in which the method of the present invention is applied is not specifically limited to the above-mentioned developing machine. For example, although the developing machine shown in FIG. 1 uses a developing sleeve 102 having an inner diameter larger than the outer diameter of the driving roller to form a slack portion 120, it is possible to use a developing sleeve in which such a slack portion is not formed, i.e. a developing sleeve having the same inner diameter as the outer diameter of the driving roller.

The developer to be introduced into the developing machine in which the method of the present invention is adopted contains toner particles having an average shape factor (SF value) of 100 to 150, preferably 100 to 140, and other desired additives. If the SF value of the toner particles exceeds 150, the toner particles, especially small size particles, conspicuously do not separate from the sleeve easily in the buffer chamber, causing sleeve filming and photoreceptor fogging. The SF value is a measure that indicates the shape of particles and is calculated as follows. The maximum length and the area in the formula are values measured by means of an image analyzer (LUZEX 5000: manufactured by Nippon Regulator K.K.).

$$SF = \frac{(\text{MAXIMUM})^2}{\text{area}} \times \frac{\pi}{4} \times 100$$

(In the formula, the area represents an average of projected area of the toner and the maximum length represents an average of the maximum length in the projected image of the toner.)

The above toner particles contained in the toner include at least a binder resin and a colorant. The binder resin to be contained in the toner particles is not specifically limited and may be, for example, a styrene-based resin, an acrylic-based resin, styrene-acrylic resins, polyamide resins, polyester resins, polyurethane resins, epoxy resins, or other known resins, which are used either alone or in a mixture thereof It is possible to select desirable ones in accordance with its use. For example, it is preferable to use a polyester resin for a toner having a negative charging property, a polyester resin for a full-color toner, and a polyester resin or a styrene-acrylic resin for a black toner.

A preferable polyester resin in the developer to be used in the method of the present invention is a resin synthesized by condensation polymerization using a bisphenol A alkylene oxide adduct as a major component as an alcohol component and a dicarboxylic acid as an acid component. A more preferable polyester resin is a resin synthesized by condensation polymerization using a bisphenol A alkylene oxide adduct at 80 mol % or more as an alcohol component and a phthalic-acid-based dicarboxylic acid at 90 mol % or more as an acid component.

Suitabel bisphenol A alkylene oxide adducts are a bisphenol A propylene oxide adduct or a bisphenol A ethylene oxide adduct. It is preferable to use a mixture of thereof.

As an alcohol component, the following diols and polyvalent alcohols may be used at a small amount in addition to the bisphenol A alkylene oxide adducts. Examples of the alcohol component include diols such as ethylene glycol, diethylene glycol, triethylene glycol, 1,2-propylene glycol, 1,3-propylene glycol, 1,4-butanediol, and neopentyl glycol, sorbitol, 1,2,3,6-hexanetetrol, 1,4-sorbitan, pentaerythritol, dipentaerythritol, tripentaerythritol, 1,2,4-butanetriol, 1,2,5-5 pentanetriol, glycerol, 2-methylpropanetriol, 2-methyl-1,2,4-butanetriol, trimethylolethane, trimethylolpropane, and 1,3,5-trihydroxymethylbenzene.

The dicarboxylic acid to be used is preferably a phthalic-acid-based one and may be, for example, a phthalic-acid-based dicarboxylic acid such as terephthalic acid or isophthalic acid, an acid anhydride thereof, or a lower alkyl ester thereof.

Also, it is possible to use an aliphatic dicarboxylic acid together with the phthalic-acid-based dicarboxylic acid. Examples of the usable aliphatic dicarboxylic acid include the ones such as fumaric acid, maleic acid, succinic acid, and alkyl or alkenyl succinic acid having 4 to 18 carbon atoms, acid anhydrides thereof, and lower alkyl esters thereof.

The binder resin to be used in the toner particles in the present invention is a binder resin having a glass transition point of 55 to 75° C., preferably 58 to 70° C., a softening point of 95 to 120° C., preferably 100 to 118° C., a number-average molecular weight of 2,500 to 6,000, preferably 3,000 to 5,500, and a weight-average molecular weight/number-average molecular weight of 2 to 8, preferably 3 to 7. If the glass transition point is lower, the heat resistance of the toner decreases. If the glass transition point is higher, the light-transmittance or the color miscibility decreases. If the softening point is lower, a high temperature offset is liable to be generated at the time of fixation If the softening point is higher, the fixation strength decreases. If the number-average molecular weight is lower, the toner is liable to be peeled off when the image is bent. If the number-average molecular weight is higher, the fixation strength decreases. If the weight-average molecular weight/number-average molecular weight is lower, a high temperature offset is liable to be generated. If it is higher, the light-transmittance decreases.

The binder resin preferably has an acid value of 1.0 to 30.0 KOH mg/g, preferably 1.0 to 25.0 KOH mg/g, more preferably 2.0 to 20.0 KOH mg/g, in view of improving the dispersion of the colorant in the binder resin. This is due to the following reason. If the acid value is smaller than 1.0 KOH mg/g, the effect of dispersion improvement decreases. If the acid value is larger than 30.0 KOH mg/g, the negative charging properties are strengthened and the change in the amount of charging due to the environment variation increases.

Examples of the colorant include various known colorants such as cyan color, magenta color, yellow color, black color, and the like. The amount of use of the colorant may be the same as a conventional amount of use. Usually, the colorant is added at an amount of about 1 to 15 parts by weight relative to 100 parts by weight of the binder resin. If a colored colorant is to be used, it is preferable to increase its dispersion properties by carrying out a master batch process or a flashing process on the colorant.

To the toner particles in the toner to be used in the present invention, a desired additive such as a charge-controlling agent and an offset-preventing agent may be added in addition to the above colorant.

The charge-controlling to be used may be a known charge-controlling agent such as a zinc salicylate complex or the like and may be selected in accordance with the purpose of use. For full-color copying, a colorless, white, or a light yellow charge-controlling agent is preferably used. The charge-controlling agent for black copying is not specifically limited. The amount of use of the charge-controlling agent is suitably set in accordance with the purpose of use. Usually, the charge-controlling agent is used at an amount in the range of 0.1 to 10 parts by weight, preferably in the range of 0.5 to 5.0 parts by weight, relative to 100 parts by weight of the binder resin.

The offset-preventing agent to be used is not specifically limited and may be, for example, a polyethylene wax, an oxidized polyethylene wax, a polypropylene wax, an oxidized polypropylene wax, a carnauba wax, a sazole wax, a rice wax, a canderilla wax, a hohoba oil wax, a beeswax, or the like. The offset-preventing agent can further reduce the problem of adhesion of the toner to the toner-regulating blade or the developing sleeve in a non-magnetic mono-component developing machine as well as improving the offset resistance properties. An amount of addition of the wax may be 0.5 to 5 parts by weight, preferably 1 to 3 parts by weight, relative to 100 parts by weight of the binder resin. If the amount of addition is smaller than 0.5 part by weight, the effect of addition is insufficient. If the amount of addition is larger than 5 parts by weight, the light transmittance and the color reproducibility decrease.

The toner particles to be used in the method of the present invention can be produced using the above binder resin, the colorant, and other desired additives by means of a known method such as a kneading/pulverizing method, a suspension polymerization method, an emulsion polymerization method, an emulsion dispersion granulation method, a capsulation method, or the like. Among these production methods, the kneading/pulverizing method is preferable in view of the production costs and the production stability, and the kneading/pulverizing method and the suspension polymerization method are preferable in view of the facility in producing toner particles having an SF value within the above-mentioned range.

In the kneading/pulverizing method, the toner particles are produced by carrying out the steps of mixing the toner particle components such as the resin and the colorant in a mixer such as a Henschel mixer, melting and kneading the mixture, cooling and roughly pulverizing the kneaded product, finely pulverizing the roughly pulverized particles, and classifying the obtained finely pulverized particles. It is preferable to adjust the volume-average particle size of the toner particles of the present invention to be within the range of 4 to 10 $\mu$m, more preferably 6 to 9 $\mu$m, in view of the highly fine reproducibility of images. In the specification of the present application, the volume-average particle size of the toner particles is a value measured by means of a Coultermultisizer (made by Coulter Counter K.K.) with an aperture diameter of 100 $\mu$m.

In producing the toner particles according to the above kneading/pulverizing method to control the SF value of the toner particles to be within the above range, any means may be employed as long as the SF value is controlled to be within the above range. For example, the toner particles may be pulverized by using a mechanical pulverizer as a crusher in the pulverizing step and suitably setting the processing conditions such as pulverizing time and the number of performing the pulverizing processes. Alternatively, the toner particles may be finely pulverized to a particle size of about 6 to 9 μm and then the surface-reforming treatment by hot air wind of 250 to 300° C. or the treatment by hybridization may be carried out. The surface-reforming treatment by hot air wind is a means for controlling the SF value by rounding the square portion of the surface of the particles into a curved surface by instantly insufflating onto the toner particles having a desired particle size a hot air wind of a temperature higher than a softening point of the binder resin which is the main component of the particles. The treatment by hybridization is a means of controlling the SF value by rounding the square portion into a curved surface by mechanically allowing the particles to collide with each other.

For example, when roughly pulverized particles with a feather mill 1 mm path obtained by the known kneading/pulverizing method are treated for plural times at 8,000 to 13,000 rpm in a mechanical crusher (Criptron System KTMI-type: made by Kawasaki Juko K.K.), toner particles having an SF value of 120 to 150 and a particle size of 6 to 9 μm are obtained. When the above roughly pulverized particles are finely pulverized in a jet mill (IDS: made by Nippon Pneumatic K.K.) and then subjected to the treatment by hybridization, toner particles having an SF value of 110 to 150 and a particle size of 6 to 9 μm are obtained. When the above roughly pulverized particles are finely pulverized in a jet mill (IDS: Nippon Pneumatic K.K.) and then subjected to the surface reforming treatment with hot air wind, toner particles having an SF value of 100 to 150 and a particle size of 6 to 9 μm are obtained.

To the developer to be used in the developing machine in which the method of the present invention is adopted, additives such as fine inorganic particles and fine resin particles are preferably added in addition to the toner particles obtained as above and having an SF value within the specific range. More preferably, small size inorganic fine particles having a specific particle size and fine strontium titanate particles are used as the fine inorganic particles in view of improving the durability, especially the charging stability, capable of maintaining the toner properties with resistance to change in the surface state of toner particles even after repetition of copying operations.

The small size inorganic fine particles to be used are inorganic fine particles having an average primary particle size of 1 to 70 nm, preferably 5 to 60 nm. The material to be used for the small size inorganic fine particles may be one of various materials conventionally used as a fluidizing agent, such as silica, alumina, titania (titanium dioxide), tin oxide, and zirconium oxide alone or in combination of two or more kinds thereof A content of the small size inorganic fine particles is preferably 0.3 to 3.0 wt %, preferably 0.5 to 2.5 wt % relative to toner particles.

It is further preferable to use a mixture of two or more kinds of inorganic fine particles having different primary particle sizes within the above range as the small size inorganic particles to be added into the above toner particles. In this case, between the smaller inorganic fine particles and the larger inorganic fine particles, preferably one kind of the fine inorganic particles are made of silica, and more preferably the other kind of the inorganic fine particles are made of titania.

It is preferable that the smaller inorganic fine particles have an average primary particle size of 1 to 30 nm, and the larger inorganic fine particles have an average particle size of 40 to 70 nm. A content of each of these inorganic fine particles may be set in such a manner that the total content of these inorganic fine particles is equal to the content of the small size inorganic fine particles. However, it is preferable that the smaller inorganic fine particles are contained at an amount of 0.1 to 2.0 wt % relative to the toner particles and the larger inorganic fine particles are contained at an amount of 0.1 to 2.5 wt % relative to the toner particles.

It is preferable that the above small size inorganic fine particles are subjected to surface treatment by a known method with a silane-based coupling agent, a titanate-based coupling agent, a conventionally used hydrophobicizing agent such as silicon-based oil and silicon varnish, or further a treating agent such as fluorine-based silane coupling agent or fluorine-based silicon oil.

The strontium titanate fine particles to be added as the inorganic fine particles preferably have an average primary particle size of 0.1 to 1.0 μm, more preferably 0.1 to 0.5 μm. By allowing the above inorganic fine particles to be contained in the toner, accumulation of toner particles or small size inorganic fine particles in the gap between the toner-regulating blade and the developing sleeve can be avoided. Even if these particles are accumulated, the accumulation is removed by polishing action of the fine particles (hereafter referred to as "refreshing effect"), so that non-uniformity of the charging properties of the toner and the formed thin toner layer due to accumulation of the toner particles, which has been conventionally a problem, can be avoided, thereby providing good copied images. Also, since the fine particles have a positive charging properties, the adhesion of the fine particles to the toner particles is effectively carried out in the case where the toner particles have a negative charging properties, thereby providing a great effect especially on the toner charging stability. Further, by the addition of the fine particles, the photoreceptor is suitably polished, so that an effect as a cleaning-improving agent can be expected.

Moreover, since the strontium titanate fine particles have a relatively larger size, the possibility of contact between the toner particles themselves is reduced, and the external stresses such as the regulation by the toner-regulating blade at the time of development and the stirring in the developing machine are diffused, so that the surface of the toner particles is not directly affected by the external stress.

In the present invention, it is preferable that the strontium titanate fine particles are subjected to surface treatment by the above hydrophobicizing agent in the same manner as the small size inorganic fine particles in view of the aggregation properties and the dispersion properties. A content of the strontium titanate fine particles is preferably 0.3 to 3.0 wt %, more preferably 0.4 to 2.0 wt % retative to toner particles.

Figure 3:
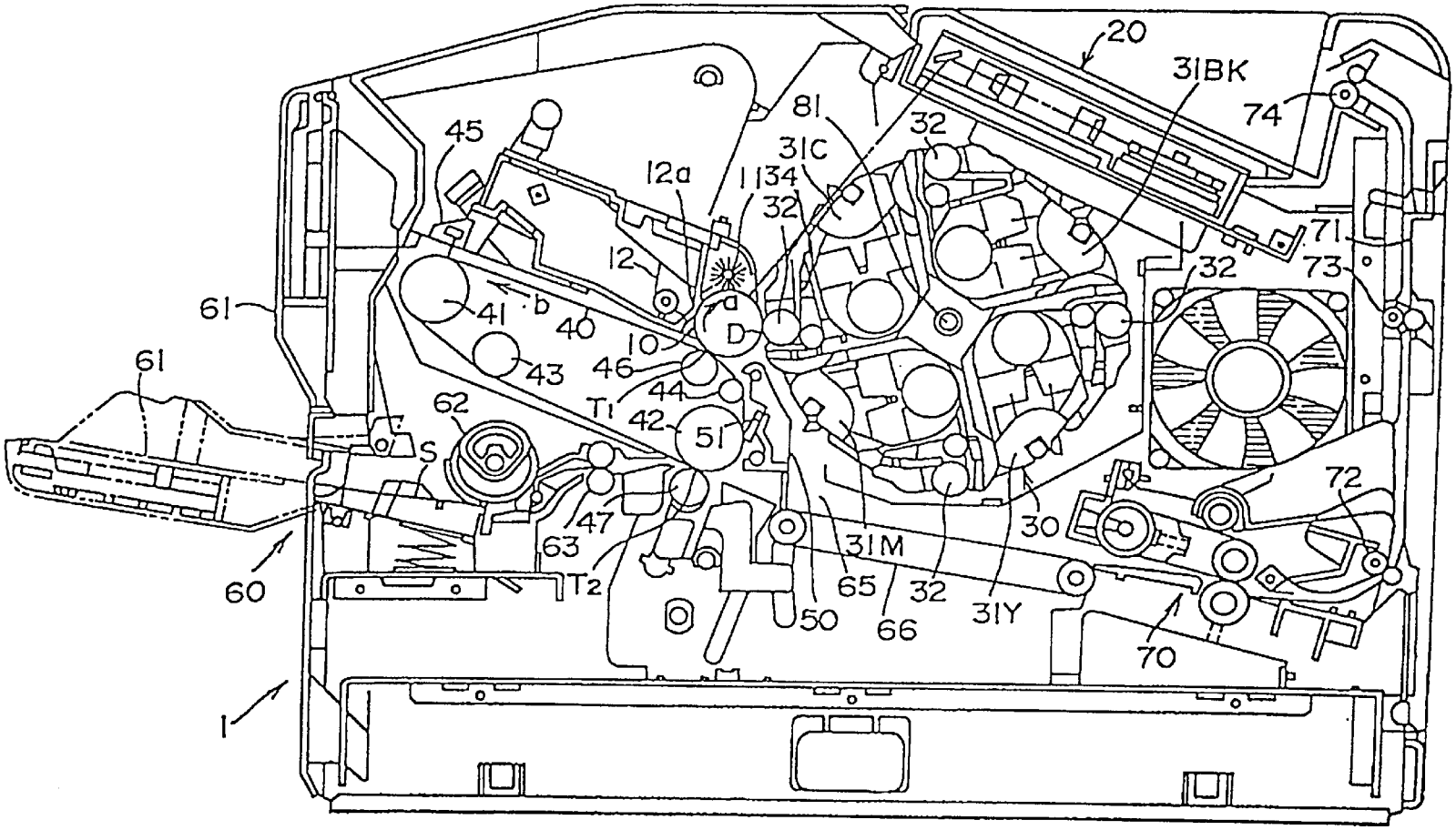
FIG. 3 is a schematic view showing a construction of a full-color image forming apparatus.

The above-mentioned mono-component developing machine in which the method of the present invention is adopted includes a predetermined static erasing element and a predetermined toner as mentioned above. In actually forming an image, the developing machine is mounted, for example, in a full-color image-forming apparatus (here, four developing machines are housed therein) to form an image, as shown in FIG. 3. This is explained hereafter with reference to FIG. 3.

Referring to FIG. 3, a full-color laser beam printer generally includes a photoreceptor drum 10 rotated and driven in a direction of arrow (a), a laser scanning optical system 20, a full-color developing machine 30, an endless intermediate transfer belt 40 rotated and driven in a direction of arrow (b), and a paper feeding section 60. A charging brush 11 for charging a surface of the photoreceptor drum 10 to a predetermined potential and a cleaner 12 including a cleaner blade 12*a* for removing the toner remaining on the photoreceptor drum 10 are disposed around the photoreceptor drum 10.

The laser scanning optical system 20 is a known one incorporating a laser diode, a polygon mirror, and an fθ optical element. To a controlling section thereof, printing data for each of the C (cyan), M (magenta), Y (yellow), and Bk (black) are transported from a host computer. The laser scanning optical system 20 outputs the printing data for each color successively as a laser beam to scan and expose on the photoreceptor drum 10. Through this operation, an electrostatic latent image for each color is formed on the photoreceptor drum 10.

The full-color developing machine 30 is an integrated assembly incorporating four developing machines 31C, 31M, 31Y, and 31Bk for four colors (each developing machine has a construction as shown in FIG. 2) each housing a mono-component developer containing a non-magnetic toner of C, M, Y, or Bk, and is rotatable in a clockwise direction with a supporting shaft 81 serving as a fulcrum. Each of the developing machines includes a developing sleeve 32, a toner-regulating blade 34, and a static erasing member (not shown). The toner transported in accordance with the rotation of the developing sleeve 32 is charged when passing through a pressing portion (regulating portion) between the blade 34 and the developing sleeve 32.

The intermediate transfer belt 40 is stretched endlessly over the supporting rollers 41, 42 and the tension rollers 43, 44, and rotated and driven in a direction shown by arrow (b) in synchronization with the photoreceptor drum 10. A protrusion (not shown) is disposed on one side of the intermediate transfer belt 40. Detection of this protrusion by a micro switch 45 enables control of the image-forming operations such as exposure, development, and transfer. The intermediate transfer belt 40 is pressed to be in contact with the photoreceptor drum 10 by a freely rotatable primary transfer roller 46. This contact portion is a primary transfer section $T_1$. The intermediate transfer belt 40 is in contact with a freely rotatable secondary transfer roller 47 at a portion supported by the supporting roller 42. This contact portion is a secondary transfer section $T_2$.

Further, a cleaner 50 is disposed in a space between the said developing machine 30 and the intermediate transfer belt 40. The cleaner 50 includes a blade 51 for removing the residual toner on the intermediate transfer belt 40. This blade 51 and the secondary transfer roller 47 can contact with and separate from the intermediate transfer belt 40.

The paper feeding section 60 includes a paper feeding tray 61 openable to the front side of the main body 1 of the image forming apparatus, a paper feeding roller 62, and a timing roller 63. Recording sheets S stacked on the paper feeding tray 61 are fed one by one towards the right side in FIG. 3 by rotation of the paper feeding roller 62 and sent to the secondary transfer section in synchronization with an image formed on the intermediate transfer belt 40 by the timing roller 63. A horizontal transport passageway 65 of the recording sheets includes an air suction belt 66 or the like, and a vertical transport passageway 71 including transport rollers 72, 73, 74 are disposed from a fixer 70. The recording sheets S are ejected onto an upper surface of the main body 1 of the image forming apparatus through the vertical transport passageway 71.

Hereinafter, a printing operation of the above full-color printer will be explained (See FIG. 3). When the printing operation is started, the photoreceptor drum 10 and the intermediate transfer belt 40 are rotated and driven at the same peripheral speed, and the photoreceptor drum 10 is charged electrically to a predetermined potential by the charging brush 11.

Subsequently, a cyan image is exposed by the laser scanning optical system 20 to form an electrostatic latent image of the cyan image. This latent image is immediately developed in the developing machine 31C and the toner image is transferred to the intermediate transfer belt 40 at the primary transfer section. Immediately after the primary transfer is ended, the developing machine 31M is switched to a developing section D to carry out the exposure, development, and primary transfer of a magenta image. Further, the switching to the developing machine 31Y and the exposure, development, and primary transfer of a yellow image are carried out. Further, the switching to the developing machine 31Bk and the exposure, development, and primary transfer of a black image are carried out. Thereby toner images are stacked on the intermediate transfer belt 40 for each primary transfer.

After the final primary transfer is finished, a recording sheet is transported to the secondary transfer section, and the full-color toner image formed on the intermediate transfer belt 40 is transferred onto the recording sheet S. After the secondary transfer is finished, the recording sheet S is transported to a belt-type contact-heating fixer 70, where the full-color toner image is fixed on the recording sheet S, and the recording sheet S is ejected onto an upper surface of the main body of the printer 1.

The present invention will be hereafter explained in more detail with reference to the following Examples.

EXAMPLES (Preparation of toner A)

A four-necked glass flask equipped with a thermometer, a stirrer, a falling-type condenser, and a nitrogen-introducing tube were loaded with polyoxypropylene(2,2)-2,2-bis(4-hydroxyphenyl)propane, polyoxyethylene(2,2)-2,2-bis(4-hydroxyphenyl)propane, and terephthalic acid at a molar ratio of 5:5:9.5. Further, a polymerization initiator (dibutyltin oxide) was added and the mixture was reacted with stirring in a nitrogen atmosphere at 220° C. in a mantle heater to give a polyester resin having a number-average molecular weight (Mn) of 4,800, a weight-average molecular weight/number-average molecular weight of 4.5, a softening point of 108° C., a glass transition point of 66° C., and an acid value (AV) of 4.2 KOH mg/g.

The molecular weight was determined by conversion into polystyrene using tetrahydrofuran as a carrier solvent by means of a gel permeation chromatography (807-IT type: manufactured by Nippon Bunko Kogyo K.K.).

The softening point was measured under a condition of temperature-raising speed of 3.0° C./min and a load of 30 kg using a die of 1.0 mm×1.0 mm with respect to 1.0 g of the sample by means of a flow tester (CFT-500: manufactured by Shimadzu K.K.). The softening point was determined as the temperature at which half of the sample flowed out.

The glass transition point was measured with respect to 10 mg of the weighed sample by means of a differential scanning calorimeter (DSC-200: Seiko Denshi K.K.). The glass transition point was determined as the shoulder value at the main heat absorption peak in the range of 30 to 80° C. using alumina as a reference.

The acid value was represented as an amount (in mg) of potassium hydroxide needed in neutralizing acidic groups using an indicator such as phenolphthalein by dissolving the weighed sample in a suitable solvent.

This polyester resin and cyan pigment (C.I. pigment blue 15-3) were put at a weight ratio of 7:3 into a pressure kneader for kneading.

The kneaded product was cooled and then pulverized by a feather mill to gibe a pigment master batch.

The above polyester resin (93 parts by weight), the pigment master batch (10 parts by weight), a polypropylene wax (Viscol TS 200: manufactured by Sanyo Kasei Kogyo K.K.: Acid value=3.5 KOH mg/g) (2 parts by weight), and zinc salicylate complex (E84: Orient Kagaku Kogyo K.K.) (1.5 parts by weight) were sufficiently mixed in a ball mill, and the obtained mixture was melted and kneaded in a twin-screw extrusion kneader (PCM-30: Ikegai Tekko K.K.), followed by cooling and rough pulverizing by a feather mill to give a roughly pulverized product.

This roughly pulverized product was finely pulverized in a jet mill (IDS: manufactured by Nippon Pneumatic K.K.) and, after carrying out a surface reforming process with a hot air wind, the obtained product was subjected to fine classification to give toner particles having a volume average particle size of 8.0 $\mu$m and an SF value of 106.

To the obtained toner particles were added 0.5 wt % of hydrophobic silica (TS500: manufactured by Cabot K.K.) and 1 wt % of anatase-type titania having an average primary particle size of 50 nm whose surface has been treated with n-hexatrimethoxysilane, and the resultant was mixed in a mixer to give toner A (negatively chargeable toner).

(Preparation of toner B)

Roughly pulverized product obtained in the same preparation process as the toner A was finely pulverized in a jet mill (IDS: manufactured by Nippon Pneumatic K.K.), and then treated with Hybridizer (NHS-I type: manufactured by Nara Kikai K.K.) and subjected to fine classification to give toner particles having a volume average particle size of 8.0 $\mu$m and an SF value of 131. To the obtained toner particles was added an additive similar to the one used in the toner A, and the resultant was mixed in a mixer to give a toner B (negatively chargeable toner).

(Preparation of toner C)

Roughly pulverized product obtained in the same preparation process as the toner A was finely pulverized in a mechanical crusher (Criptron System KTM-I type: manufactured by Kawasaki Jukogyo K.K.), and then subjected to fine classification to give toner particles having a volume average particle size of 8.0 $\mu$m and an SF value of 143. To the obtained toner particles was added an additive similar to the one used in the toner A, and the resultant was mixed in a mixer to give a toner C (negatively chargeable toner).

(Preparation of toner D)

Roughly pulverized product obtained in the same preparation process as the toner A was finely pulverized in a jet mill (IDS: manufactured by Nippon Pneumatic K.K.), and then subjected to fine classification to give toner particles having a volume average particle size of 8.0 $\mu$m and an SF value of 162. To the obtained toner particles was added an additive similar to the one used in the toner A, and the resultant was mixed in a mixer to give a toner D (negatively chargeable toner).

Example 1

An electrophotographic printer (SP 1,000: manufactured by Minolta K.K., system speed: 35 mm/s) was loaded with a toner C to evaluate the anti-adhesion properties of the toner particles to the blade, fogging on the photoreceptor by the toner particles, filming of toner particles on the sleeve, and an adhering amount of toner particles on the sleeve. The developing machine mounted in the electrophotographic printer used in the Example is the developing machine shown in FIG. 1, and the various conditions are as follows.

Electrostatic erasing member

Material: polyamide resin (nylon) containing 25 wt % of carbon black dispersed therein Surface resistance: $10^3$ Ω

Applied voltage: +50 V

Pressing contact pressure: 110 g/cm$^2$

Material thickness: 0.2 mm (Anti-adhesion properties)

The photoreceptor was dismounted from the above electrophotographic printer and the sleeve was continuously rotated for 20 hours. After the rotation is ended, the thin toner layer on the sleeve was observed visually to evaluate the anti-adhesion properties to be ranked as follows. If an adhesion takes place on the blade, a streak appears in the thin toner layer on the sleeve.

○: No streaks were observed.

Δ: Only a slight amount of streaks were observed without raising any practical problem.

×: Generation of steaks was conspicuous.

(fogging on photosensitive member)

An image with a B/W ratio of 5% was copied. The photoreceptor was observed visually at an initial stage and after 6,000 sheets were copied, to evaluate the photoreceptor fogging to be ranked as follows.

Method of evaluating the photoreceptor fogging

A toner is set in the developing machine of an imaging cartridge and the developing machine is mounted in a printer. After an image having a D/W ratio of 5% is copied on 5 to 10 sheets (at an initial stage) and after the image is printed on 6,000 sheets, a sheet of paper is allowed to pass through in a white developing (white paper mode) and the passing of the sheet is terminated halfway.

After the passing of the sheet is terminated, the imaging cartridge is taken out from the printer to observe the photoreceptor fogging ○: Little amount of fogging was observed.

Δ: A little fogging was observed without raising any practical problem.

×: Fogging was generated.

(Sleeve filming)

The photoreceptor was taken out from the above electrophotographic printer and the sleeve was continuously rotated for 20 hours. After the rotation of the sleeve was ended, the sleeve was observed visually to evaluate the sleeve filming. The evaluation was ranked as follows. The sleeve filming refers to a coated film on the sleeve due to the toner particle components formed on the surface of the sleeve caused by fusion of toner particles and the like.

○: No filming was observed.

Δ: A slight filming was observed without raising any practical problem.

×: Generation of filming was conspicuous.

(Amount of fine particles of toner particles on the sleeve)

The photoreceptor was dismounted from the above electrophotographic printer. The system speed was changed to 75 mm/s, the sleeve was continuously rotated 30 minutes to determine the ratio (% in number) occupied by toner particles having a particle size of 5 $\mu$m or less in the thin toner-layer formed on the sleeve. Specifically, the thin toner layer formed on the sleeve was sucked in and the number-standard particle distribution of the sucked toner samples was measured to confirm the ratio of the number of toner particles having a particle size of 5 μm or less contained in the toner sample at that moment.

○: 0% by number or more and 20% by number or less

Δ: 20% by number or more and 30% by number or less

×: 30% by number or more

The above evaluation results are shown in Table 1 with the other conditions.

Example 2

The evaluation was carried out in the same manner as in Example 1 except that the toner A was used and a static erasing member containing 15 wt % of carbon black and having a surface resistance of $10^5$ Ω was used.

Example 3

The evaluation was carried out in the same manner as in Example 1 except that the toner B was used and a static erasing member containing 15 wt % of carbon black and having a surface resistance of $10^5$ Ω was used.

Example 4

The evaluation was carried out in the same manner as in Example 1 except that a static erasing member containing 15 wt % of carbon black and having a surface resistance of $10^5$ Ω was used.

Example 5

The evaluation was carried out in the same manner as in Example 1 except that the voltage applied to the static erasing member was +100 V.

Comparative Example 1

The evaluation was carried out in the same manner as in Example 1 except that the toner D was used, a static erasing member containing 15 wt % of carbon black and having a surface resistance of $10^5$ Ω was used, and no voltage was applied to the static erasing member.

Comparative Example 2

The evaluation was carried out in the same manner as in Example 1 except that the toner D was used, a static erasing member containing 13 wt % of carbon black and having a surface resistance of $10^6$ Ω was used, and a voltage of +100 V was applied to the static erasing member.

Comparative Example 3

The evaluation was carried out in the same manner as in Example 1 except that the toner D was used, a static erasing memer containing 15 wt % of carbon black and having a surface resistance of $10^5$ Ω was used, and a voltage of +150 V was applied to the static erasing member.

Comparative Example 4

The evaluation was carried out in the same manner as in Example 1 except that the toner B was used, a static erasing member containing 15 wt % of carbon black and having a surface resistance of $10^5$ Ω was used, and no voltage was applied to the static erasing member.

TABLE 1

| | | | | Evaluation | | | | |
|---|---|---|---|---|---|---|---|---|
| | | Static eraser | | | Photoreceptor fogging | | | |
| Examples/ Comparative Examples | Toner species (SF value) | Surface resistance (Ω) | Applied voltage (V) | Anti-adhesion properties | At initial stage | After 6000 sheets | Sleeve filming | Amount of fine particles on the sleeve |
| Example 1 | C (143) | $10^3$ | +50 | ○ | ○ | ○ | ○ | Δ |
| Example 2 | A (106) | $10^5$ | +50 | ○ | ○ | ○ | ○ | ○ |
| Example 3 | B (131) | $10^5$ | +50 | ○ | ○ | ○ | ○ | ○ |
| Example 4 | C (143) | $10^5$ | +50 | ○ | ○ | ○ | Δ | Δ |
| Example 5 | C (143) | $10^3$ | +100 | ○ | ○ | ○ | ○ | Δ |
| Example 6 | A (106) | $10^5$ | +100 | ○ | ○ | ○ | ○ | ○ |
| Example 7 | B (131) | $10^5$ | +100 | ○ | ○ | ○ | ○ | ○ |
| Example 8 | C (143) | $10^5$ | +100 | ○ | ○ | ○ | ○ | Δ |
| Comparative Example 1 | D (162) | $10^5$ | 0 | Δ | ○ | x | x | x |
| Comparative Example 2 | D (162) | $10^6$ | +100 | ○ | ○ | ○ | x | x |
| Comparative Example 3 | D (162) | $10^5$ | +150 | ○ | ○ | Δ | x | x |
| Comparative Example 4 | B (131) | $10^5$ | 0 | Δ | ○ | Δ | x | x |

Example 6

The evaluation was carried out in the same manner as in Example 5 except that the toner A was used and a static erasing member containing 15 wt % of carbon black and having a surface resistance of $10^5$ Ω was used.

Example 7

The evaluation was carried out in the same manner as in Example 5 except that the toner B was used and a static erasing member containing 15 wt % of carbon black and having a surface resistance of $10^5$ Ω was used.

Example 8

The evaluation was carried out in the same manner as in Example 5 except that a static erasing member containing 15 wt % of carbon black and having a surface resistance of $10^5$ Ω was used.

According to the mono-component developing method of the present invention, sleeve filming and photoreceptor fogging are not easily generated, and toner particles are not easily accumulated on the sleeve. Also, adhesion of toner particles on the blade does not occur easily.

What is claimed is:

1. A mono-component developing method comprising the steps of:

supplying a mono-component developer containing toner particles, first inorganic fine particles and second inorganic fine particles to a developer transporting member to a developer transporting member, said toner particles having an average shape factor (SF value) of 100 to 150, the first inorganic fine particles and the second fine particles added externally to the toner particles, an average primary particle size of the second inorganic fine particles being larger than that of the first inorganic fine particles;

regulating the developer on the developer transporting member by a regulating member to form a thin developer-layer on the transporting member;

transporting the thin developer-layer by the transporting member to develop an electrostatic latent image; and after development, making a residual developer on the developer transporting member in contact with a static erasing member applied with a voltage having a polarity opposite to a charging polarity of the toner particles.

2. A mono-component developing method of claim 1, in which the toner particles have a volume-average particle size within the range of 4 to 10 $\mu$m.

3. A mono-component developing method of claim 1, in which the toner particles have a volume-average particle size within the range of 6 to 9 $\mu$m and an average shape factor of 100 to 140.

4. A mono-component developing method of claim 1, in which the toner particles comprise a binder resin having an acid value of 1.0 to 30.0 KOH mg/g.

5. A mono-component developing method of claim 1, in which the first inorganic fine particles have the average primary particles size of 1 to 70 nm.

6. A mono-component developing method of claim 5, in which the second inorganic fine particles have the average primary size of 0.1 to 1 $\mu$m.

7. A mono-component developing method of claim 1, in which the first inorganic fine particles have the average primary particle size of 1 to 30 nm and the second inorganic fine particles have the average primary particle size of 40 to 70 nm.

8. A mono-component developing method of claim 1, in which the toner particles comprise a binder resin having a glass transition point of 55 to 75° C., a softening point of 95 to 120° C., a number-average molecular weight of 2,500 to 6,000, and a weight-average molecular weight/number-average molecular weight of 2 to 8.

9. A mono-component developing method of claim 1, in which a voltage in absolute value of 50 to 100 V is applied to the static-erasing member.

10. A mono-component developing method of claim 1, in which the static-erasing member is composed of a blade member having a thickness of 0.15 to 0.25 mm and the blade member comprises a resin and 10 to 30 parts by weight of electrically conductive fine particles on the basis of 100 parts by weight of the resin.

11. A mono-component developing method of claim 1, in which the static-erasing member has a surface resistance of $10^2$ to $10^6$ Ω.

12. A mono-component developing machine, comprising:

a developer container accommodating a mono-component developer containing toner particles having an average shape factor of 100 to 150, first inorganic fine particles and second inorganic fine particles, the first inorganic fine particles and the second inorganic fine particles added externally to the toner particles, an average primary particle size of the second inorganic fine particles being larger than that of the first inorganic fine particles;

a developer-transporting member transporting the mono-component developer provided from the developer container;

a regulating member regulating the developer on the developer-transporting member to form a thin developer-layer on the developer-transporting member;

a static-erasing member arranged in contact with a residual developer on the developer-transporting member after an electrostatic latent image is developed by the developer on the developer-transporting member, and;

a voltage applying member applying to the static erasing member a voltage having a polarity opposite to a charging polarity of the toner particles.

13. A mono-component developing machine of claim 12, in which the toner particles have a volume-average particle size within the range of 6 to 9 $\mu$m and an average shape factor of 100 to 140.

14. A mono-component developing machine of claim 12, in which the toner particles comprise a binder resin having an acid value of 1.0 to 30.0 KOH mg/g.

15. A mono-component developing machine of claim 12, in which the first inorganic fine particles have the average primary particle size of 1 to 70 nm.

16. A mono-component developing machine of claim 15, in which the second inorganic fine particles have the average primary particle size of 0.1 to 1 um.

17. A mono-component developing machine of claim 12, in which the first inorganic fine particles have the average primary particle size of 1 to 30 nm and the second inorganic fine particles have the average primary particle size of 40 to 70 nm.

18. A mono-component developing machine of claim 12, in which the toner particles comprise a binder resin having a glass transition point of 55 to 75° C., a softening point of 95 to 120° C., a number-average molecular weight of 2,500 to 6,000, and a weight-average molecular weight/number-average molecular weight of 2 to 8.

19. A mono-component developing machine of claim 12, in which a voltage in absolute value of 50 to 100 V is applied to the static-erasing member.

20. A mono-component developing machine of claim 12, in which the static-erasing member is composed of a blade member having a thickness of 0.15 to 0.25 mm and the blade member comprises a resin and 10 to 30 parts by weight of electrically conductive fine particles on the basis of 100 parts by weight of the resin.

21. A mono-component developing machine of claim 12, in which the static-erasing member has a surface resistance of $10^2$ to $10^6$ Ω.

22. A mono-component developing method comprising the steps of:

supplying a mono-component developer containing toner particles having an average shape factor (SF value) of 100 to 150 to a developer transporting member;

regulating the developer on the developer transporting member by a regulating member to form a thin developer-layer on the transporting member;

transporting the thin developer-layer by the transporting member to develop an electrostatic latent image; and after development, making a residual developer on the developer transporting member in contact with a static erasing member applied with a voltage having a polarity opposite to a charge polarity of the toner particles, the static erasing member fixedly arranged and applied to the voltage having absolute value of 50 to 100 V.

23. A mono-component developing method of claim 22, in which the absolute value is 50 to 80 V.

24. A mono-component developing machine, comprising:

a developer container accommodating a mono-component developer containing toner particles having an average shape factor of 100 to 150;

a developer-transporting member transporting the mono-component developer provided from the developer container;

a regulating member regulating the developer on the developer-transporting member to form a thin developer-layer on the developer-transporting member;

a static-erasing member fixedly arranged in contact with a residual developer on the developer-transporting member after an electrostatic latent image is developed by the developer on the developer-transporting member, and;

a voltage applying member applying to the static erasing member a voltage having a polarity opposite to a charging polarity of the toner particles, the voltage having absolute value of 50 to 100 V.

25. A mono-component developing machine of claim 24, in which the absolute value is 50 to 80 V.

* * * * *